US009139208B2

(12) United States Patent
Eriksson

(10) Patent No.: US 9,139,208 B2
(45) Date of Patent: Sep. 22, 2015

(54) SUPPORT DEVICE FOR A LATERALLY DISPLACEABLE RAILWAY WAGON

(75) Inventor: Jan Eriksson, Nalden (SE)

(73) Assignee: Flexiwaggon AB, Ostersund (SE)

( * ) Notice: Subject to any disclaimer, the term of this patent is extended or adjusted under 35 U.S.C. 154(b) by 0 days.

(21) Appl. No.: 14/124,950

(22) PCT Filed: Jun. 20, 2012

(86) PCT No.: PCT/SE2012/050691

§ 371 (c)(1),
(2), (4) Date: Dec. 9, 2013

(87) PCT Pub. No.: WO2012/177216

PCT Pub. Date: Dec. 27, 2012

(65) Prior Publication Data

US 2014/0116289 A1 May 1, 2014

(30) Foreign Application Priority Data

Jun. 21, 2011 (SE) ..... 1150570

(51) Int. Cl.
*B61D 3/00* (2006.01)
*B61D 47/00* (2006.01)
*B61D 3/18* (2006.01)

(52) U.S. Cl.
CPC *B61D 47/00* (2013.01); *B61D 3/18* (2013.01); *B61D 3/184* (2013.01); *B61D 47/005* (2013.01)

(58) Field of Classification Search
CPC ..... B61D 47/00; B61D 47/005; B61D 3/00; B61D 3/18; B61D 3/187; B61D 3/184; B61D 3/04; B61D 3/16; B61D 3/14; B61D 3/10; B61D 15/00
USPC ..... 105/355, 404; 414/333, 339; 410/1
See application file for complete search history.

(56) References Cited

U.S. PATENT DOCUMENTS 3,352,438 A * 11/1967 Davidson ..... 414/333
3,516,368 A * 6/1970 Wright ..... 105/455
3,581,918 A * 6/1971 Fujioka ..... 414/395

(Continued)

FOREIGN PATENT DOCUMENTS

DE 4304635 A1 8/1994
DE 19723550 A1 12/1998

(Continued)

OTHER PUBLICATIONS

International Search Report PCT/ISA/210 for PCT/SE2012/050691 dated Nov. 6, 2012.

*Primary Examiner* — Jason C Smith
(74) *Attorney, Agent, or Firm* — Harness, Dickey & Pierce, P.L.C.

(57) ABSTRACT

A support device for a laterally displaceable railway wagon includes a track device including an endless track, a body carrying the endless track, and a track device holder, which is pivotally connected with the body via a connection shaft extending transversally through the body. The track device holder includes opposite first and second side portions extending along the length of the track device, a first end portion connected with the first and second side portions at one end thereof, a second end portion connected with the side portions at the other end thereof, a first suspension portion included in said first end portion, and a second suspension portion included in said second end portion. The track device at least partly extends below the track device holder.

20 Claims, 6 Drawing Sheets

(56) References Cited

U.S. PATENT DOCUMENTS

| | | | | |
|---|---|---|---|---|
| 3,884,158 | A * | 5/1975 | Rumell | 410/1 |
| 3,916,799 | A * | 11/1975 | Smith | 410/1 |
| 4,776,735 | A * | 10/1988 | Walda et al. | 410/1 |
| 4,780,033 | A * | 10/1988 | Walda et al. | 410/1 |
| 4,880,341 | A * | 11/1989 | Van Den Pol | 410/1 |
| 4,948,310 | A * | 8/1990 | Ord | 410/1 |
| 5,281,072 | A * | 1/1994 | Patouillard et al. | 414/349 |
| 7,650,844 | B2 * | 1/2010 | Eriksson | 105/355 |
| 2007/0025831 | A1 * | 2/2007 | Burt et al. | 414/339 |
| 2008/0271634 | A1 * | 11/2008 | Eriksson | 105/355 |
| 2012/0017799 | A1 * | 1/2012 | Linde | 105/4.1 |
| 2013/0139719 | A1 * | 6/2013 | Kun | 105/355 |
| 2013/0255533 | A1 * | 10/2013 | Boring et al. | 105/355 |
| 2014/0116289 | A1 * | 5/2014 | Eriksson | 105/355 |
| 2014/0133954 | A1 * | 5/2014 | Da Guia Nunes | 414/812 |
| 2014/0165872 | A1 * | 6/2014 | Nooren | 105/355 |
| 2014/0212258 | A1 * | 7/2014 | Hathaway et al. | 414/809 |

FOREIGN PATENT DOCUMENTS

| | | | |
|---|---|---|---|
| DE | 19813440 | A1 | 10/1999 |
| DE | 102005037148 | A1 | 2/2006 |
| EP | 1805072 | A1 | 7/2007 |
| WO | WO-9611829 | A1 | 4/1996 |

* cited by examiner

SUPPORT DEVICE FOR A LATERALLY DISPLACEABLE RAILWAY WAGON

CROSS-REFERENCE TO RELATED APPLICATIONS

This application is the national phase under 35 U.S.C. §371 of PCT International Application No. PCT/SE2012/050691 which has an International filing date of Jun. 20, 2012, which claims priority to Swedish patent application number 1150570-8 filed Jun. 21, 2011.

FIELD OF THE INVENTION

The present invention relates to a support device for a laterally displaceable railway wagon, and to a railway wagon comprising such a support device.

BACKGROUND OF THE INVENTION

It is an environmental benefit to transport vehicles by train. In order to facilitate such transport laterally displaceable railway wagons have been developed. A laterally displaceable railway wagon is a railway wagon that can be laterally displaced by swinging out one end thereof, or more particularly one end of a load carrier that is a part of the whole wagon, such that the vehicle can be driven on board the wagon. Alternatively, the wagon, or a load carrier thereof, is moved in parallel, or it is rotated about a centre seat. Then the wagon is returned to its original position and the train may depart.

In order to facilitate the displacement of the wagon, and keep the balance thereof, it is provided with some kind of support device. In EP1805072 a support device arranged at both ends of the load carrier of the railway wagon is disclosed. The support device comprises a lever which is rotatably attached to a fixed seat of the load carrier at one end of the lever, and rotatably attached to an operating device at the other end. An abutment unit comprising a ski and a wheel is rotatably connected with the lever and is lowered into contact with the ground when the operating device is operated for lowering the lever. The prior art support device mostly works well, however it has a tendency to dig itself into the ground when the ground is soft.

SUMMARY OF THE INVENTION

It is an object of the resent invention to provide a support device that alleviates the above-mentioned problems of the prior art.

The object is achieved by a support device according to the present invention as defined in claim 1.

Thus, in accordance with an aspect of the present invention, there is provided a for a laterally displaceable railway wagon, where the support device comprises a track device including an endless track, and a body carrying the endless track; and a track device holder, which is pivotally connected with the body via a connection shaft extending transversally through the body. The track device holder comprises opposite first and second side portions extending along the track device, a first end portion connected with the first and second side portions at one end thereof, a second end portion connected with the side portions at the other end thereof, a first suspension portion included in said first end portion, and a second suspension portion included in said second end portion. The track device at least partly extends below the track device holder.

Relative to the prior art support device, the present support device, employing the endless track, has an increased capability of coping with any kind of ground that could be at hand alongside of a railroad. Furthermore, due to the pivotal attachment of the track device to the track device holder, it easily follows an uneven ground.

It should be noted that the use of a track device per se as a support device is disclosed in DE 19813440, but there is no description of how the track device should be constructed, or how it should be mounted on the wagon, etc. In fact, DE 19813440 merely mentions the use of tracks for supporting a load carrier when it is laterally displaced. However, from FIG. 2 it is evident that the tracks are rigidly mounted underneath the loading ramp and that they are meant to be used in connection with a railway wagon that is loaded and unloaded adjacent to a platform, which is substantially raised above ground level, i.e. the level of the rails. Consequently, the support device of DE 19813440 would be of no use to a skilled person facing the above-mentioned problem.

In accordance with an embodiment of the support device, track device holder comprises slide stop portions, keeping the track from excessive lateral displacement on the body, arranged on either side of the track device. For instance, the slide stop portions are provided by the side portions, or they are arranged as individual portions. This means that there is no need for guiding means, such as protrusions, at the underside of the endless track.

In accordance with an embodiment of the support device, the track is non-driven. Thereby a simple construction is obtained.

In accordance with an embodiment of the support device, the track device comprises a drive unit arranged to drive the track. With this embodiment, on the other hand, the lateral displacement is aided. In accordance with an embodiment of the support device, the body comprises opposite side plates covering the interior of the body, and supporting the track, at an inner surface thereof, the side plates each comprising a seat for receiving the connection shaft, which extends through the seats and is connected with the track device holder. Thus, when the endless track moves around the body it is supported by the side plates, and the side plates, in turn, are supported on the connection shaft. A robust structure is obtained which prevents stones of a detrimental size from entering the interior of the track device.

In accordance with an embodiment of the support device, the body comprises two turn rolls arranged within the endless track, and rotatably attached to the side plates at their respective ends, wherein the turn rolls are arranged to tension the track.

In accordance with an embodiment of the support device, the connection shaft is arranged centrally of the track device, and the track device is able to seesaw relative to the track device holder. This structure provides the support device with a self controlled freedom of pivotal movement of the track device.

In accordance with an embodiment of the support device, the connection shaft is embodied by the centre shaft of one of the turn rolls, and a pivot limiter is connected with the body and with the track device holder at a distance from the connection shaft. In this embodiment it is possible to use one shaft less, since the shaft of the turn roll is additionally used as connection shaft.

In accordance with an embodiment of the support device, the track comprises solid links, which are pivotally connected with each other. Thus, a strong structure of the endless track is provided.

In accordance with an embodiment of the support device, each link is elongated and has generally square wave shaped long side surfaces, wherein a top portion of one long side surface is opposite to a bottom portion of the other long side surface, and wherein the links are interconnected by means of connection pins extending along the length of the links through the top portions. This track structure provides for a track which is mountable with a relatively small radius of the turn rolls thereby advantageously limiting the height of the track device.

According to an aspect of the present invention, there is provided a laterally displaceable railway wagon comprising a support device as defined above.

In accordance with an embodiment of the railway wagon, it comprises a load carrier and front and rear bogies, the load carrier being releasably connected to the respective bogies, and laterally displaceable in relation to the respective bogies. The load carrier has a front and a rear end and it is provided with support devices at each end of the load carrier. The support devices support the load carrier in a position where it is displaced in relation to one or both of the bogies, wherein each support device is vertically operable between an idle position and a support position, in which the support device abuts against a base.

In accordance with an embodiment of the railway wagon, it further comprises an operating device at each end of the load carrier, for lowering and raising the support device, wherein the track device holder is elongated and comprises a first attachment portion at one end thereof, and a second attachment portion at the other end thereof, the first attachment portion being rotatably attached to the load carrier, and the second attachment portion being rotatably attached to the operating device. Thereby the operation of the support device becomes reliable and simple.

These and other aspects and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

Figure 1:
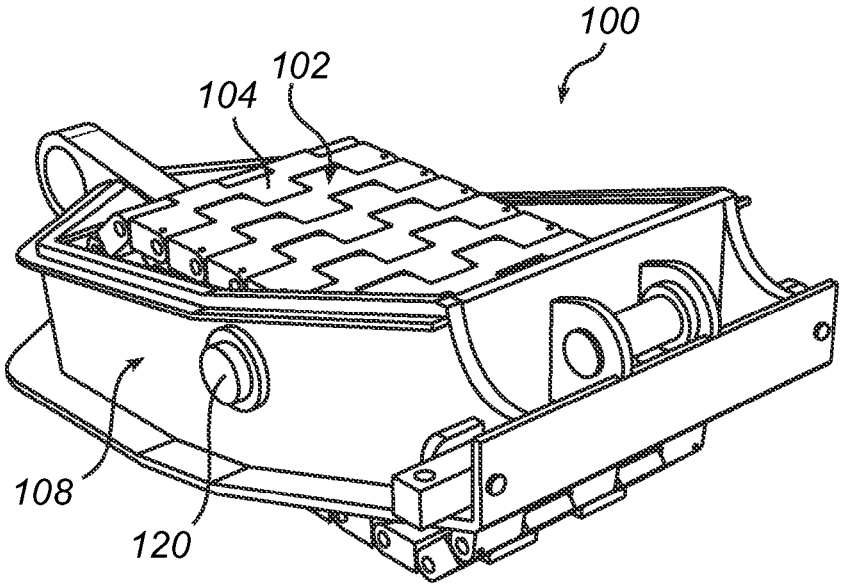
FIG. 1 is a schematic perspective view of an embodiment of a support device according to the present invention.
Figure 2:
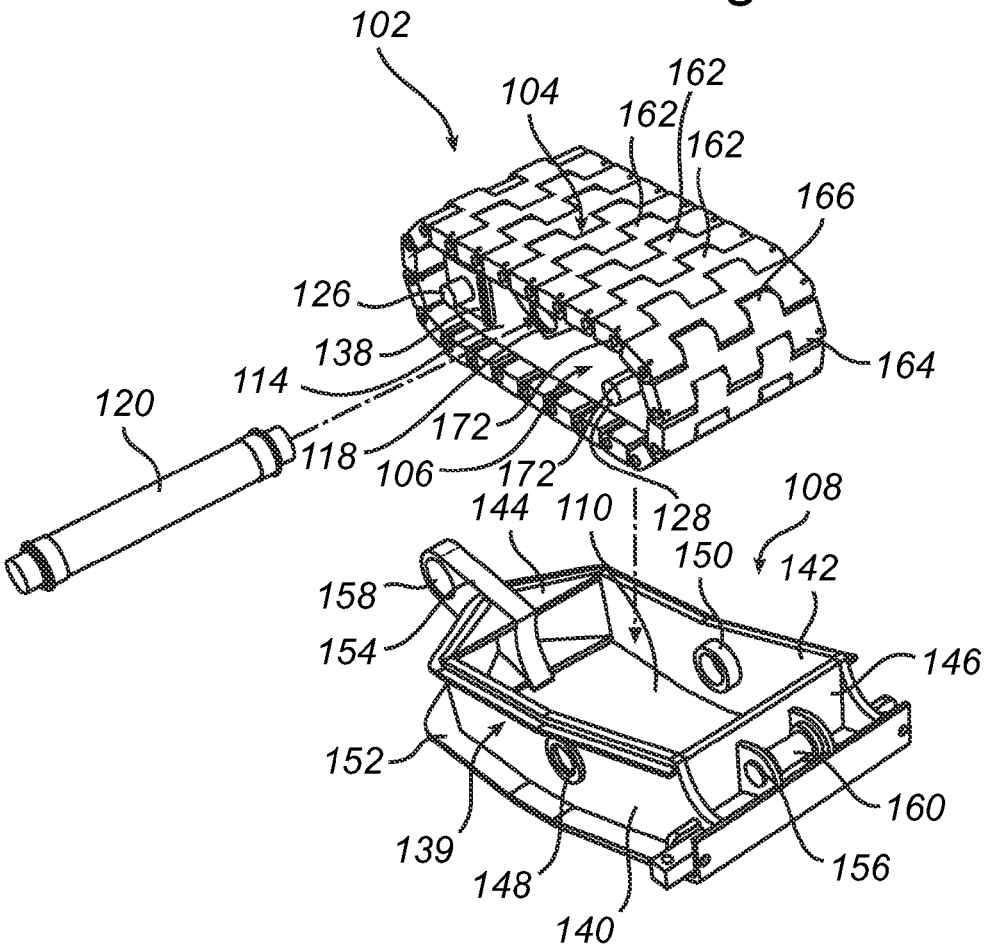
FIG. 2 is a schematic exploded view, showing the major parts of the support device shown in FIG. 1.
Figure 3:
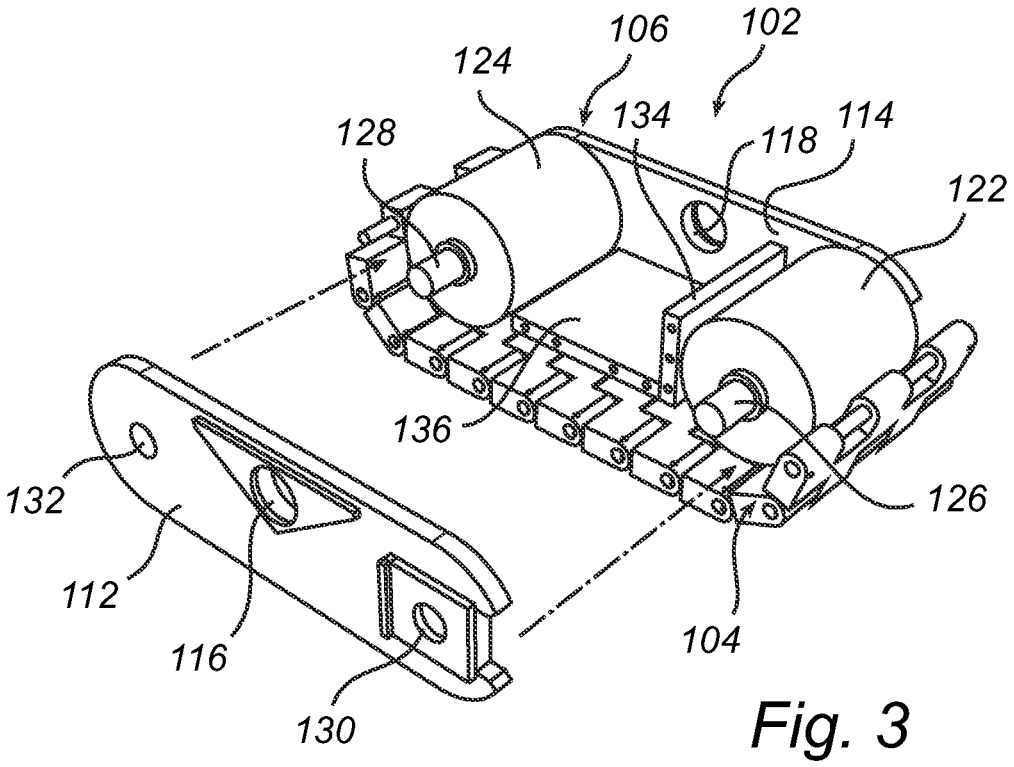
FIG. 3 is a schematic exploded view of one of the major parts just mentioned.

Referring to FIGS. 1 to 3, a first embodiment of the support device 100 comprises a track device 102 including an endless track 104 and a body 106 carrying the endless track 104. The support device 100 further comprises a track device holder 108, which is pivotally connected with the body 106 via a connection shaft 120 extending transversally through the body 106, and which is provided with a bottom opening 110 through which the track device 102 partly protrudes. More particularly, the body 106 comprises opposite side plates 112, 114 covering the interior of the body 106, the side plates 112, 114 each comprising a centre seat 116, 118 for receiving the connection shaft 120 at the centre of the body 106. The connection shaft 120 extends through the seats 116, 118 and is connected with the track device holder 108. It should be noted that the seats 116, 118 could be arranged off-centre as well, such as closer to one end of the track device 102 than the other. The track device 102 is able to seesaw, about the connection shaft 120, relative to the track device holder 108. The side plates 112, 114 are attached to each other via intermediate distance members 134, 136, which stabilize the body 106, and determine the distance between the side plates 112, 114. The distance is a bit shorter than the width of the endless track 104. The body 106 further comprises first and second turn rolls 122, 124, which are arranged within the endless track 104, and which are rotatably attached to the side plates 112, 114 at their respective ends. Each turn roll 122, 124 has a centre shaft 126, 128, which is received in respective seats 130, 132 of the side plates 112, 114. The turn rolls 122, 124 are arranged to tension the endless track 104, which runs round the rolls 126, 128. For that purpose the seats 130 for the shaft 126 of at least one of the turn rolls 122 are movable longitudinally of the side plates 112, 114, and a tensioning member 138 is provided at each one of those seats 130 for adjusting the longitudinal position of the seat 130.

The track device holder 108 comprises a base portion 139 including first and second elongate side portions 140, 142, extending along the length of the track device 102, and first and second end portions 144, 146 interconnecting the side portions 140, 142 at their respective ends. Thereby the base portion 139 has a general rectangular, and collar shaped, structure. The side portions 140, 142 are provided with a respective centrally positioned seat 148, 150, wherein the centre shaft 120 holding the body 106 has been received and locked as regards movements of the centre shaft 120 in its longitudinal direction. Thus, the track device 102 is housed within the track device holder 108. However, the height of the base portion 139 is lower than the height of the track device 102, which means that the track device 102 extends below the base portion 139 as mentioned above. However, this could be obtained with a higher base portion than the track device 102 as well, if the seats 148, 150 are appropriately positioned. The inner length of the track device holder 108 opening 110 exceeds the length of the track device 102.

Further, the track device holder 108 comprises a flange 152 extending all around the base portion 139 at its bottom opening 110. The flange 152 embodies a reinforcement of the base portion 139 and protrudes horizontally of the side and end portions 140, 142, 144, 146 like a frame at their bottom edges. In case the ground is soft and the track device 102 would sink into the ground the flange 152 may additionally serve as a ski preventing the support device 100 from sinking even deeper into the ground.

The endless track 104 is kept from lateral displacement on the body 106 by means of the side portions 140, 142, which are positioned adjacent to the endless track 104 at opposite sides thereof. This means that there is no need for guiding means, such as protrusions, at the underside of the endless track 104, and the rolls 122, 124 can be made with a substantially smooth surface, which simplifies their design.

The track device holder 108 furthermore comprises a first suspension portion 154 at the first end portion 144 thereof, and a second suspension portion 156 at the opposite second end portion 146 thereof. The first suspension portion 154 is arranged for rotatable attachment to the railway wagon and comprises an attachment seat 158, and the second suspension portion 156 is arranged for attachment to an operating device of the railway wagon for lowering and raising the support device 100, and it comprises an attachment pin 160.

Figure 10:
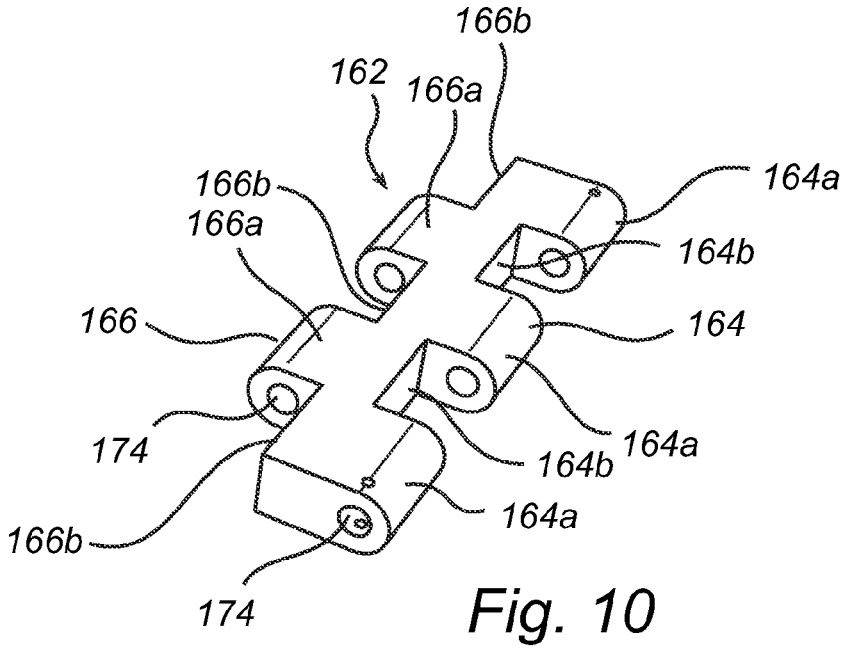
FIG. 10 is a schematic perspective view of an embodiment of a link of an endless track comprised in the support device.

The endless track 104 comprises solid links 162, which are pivotally connected with each other. Also referring to FIG. 10, each link 162 is elongate and has generally square wave shaped long side surfaces 164, 166, where a top portion 164*a* and 166*a* of one long side surface 164, 166, respectively, is opposite to a bottom portion 166*b* and 164*b* of the other long side surface 166, 164, respectively. Each top portion 164*a*, 166*a* is outwardly bulged and each bottom portion 166 is flat. The links 162 are mounted side by side to form the track 104, such that the top portions 164*a*, 166*a* of one link 162 face the bottom portions 164*b*, 166*b* of the adjacent link 162. The links 162 are interconnected by means of connection pins 172 extending along the length of the links 162 through holes 174 of the top portions 164*a*, 166*a*. This endless track structure provides for a strong endless track 104 and for an endless track which is mountable with a relatively small radius of the turn rolls 122, 124, thereby advantageously limiting the height of the track device 102. Typical diameters of the turn rolls 122 are less than 0.5 m, and a preferred diameter in this embodiment is 0.35 m, when used in the railway wagon application. It should be noted that at least the very endless track would be useful in other applications as well. However, it shows the particular advantages mentioned in this description when applied to a laterally displaceable railway wagon.

In accordance with this first embodiment of the support device 100, the endless track 104 is non-driven. Thereby a simple design is obtained.

Figure 4:
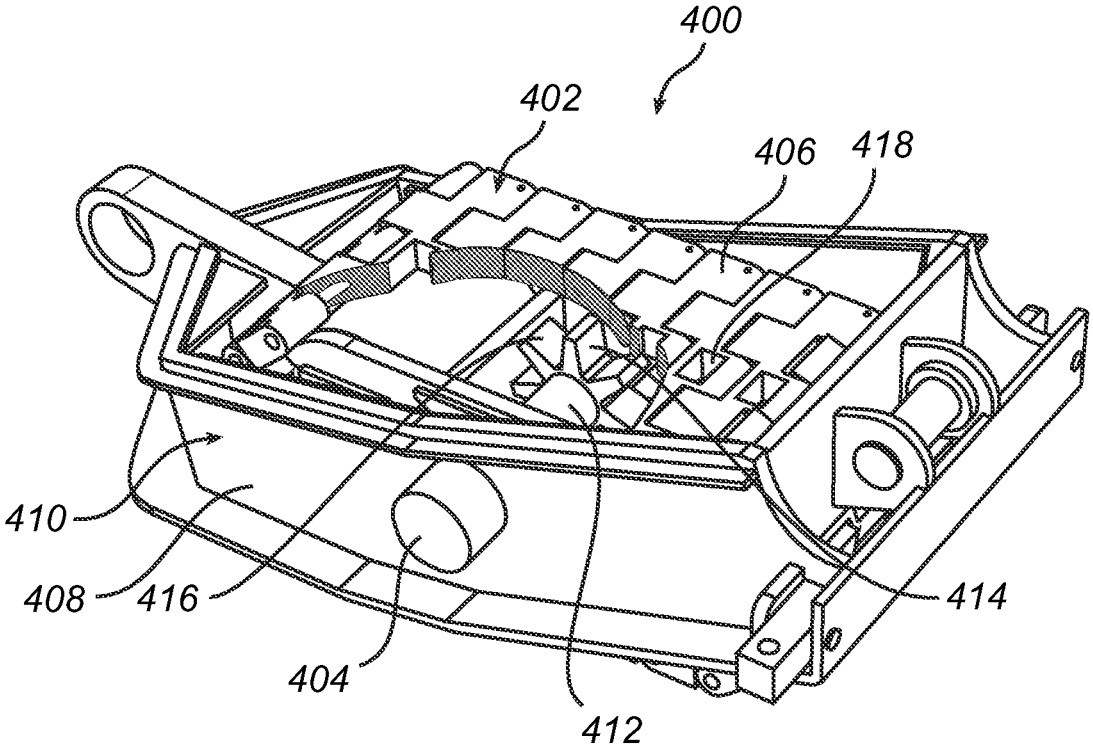
FIG. 4 is a schematic perspective view of another embodiment of the support device according to the present invention.

In accordance with a second embodiment of the support device 400, as shown in FIG. 4, the track device 402 comprises a drive unit 404 arranged to drive the endless track 406. With this embodiment, on the other hand, the lateral displacement is aided. The drive unit 404 is attached to a side portion 408 of the track device holder 410, and to the connection shaft 412, which pivotally connects the track device 402 with the track device holder 410. The connection shaft 412 is provided with a feeder wheel 414, which feeds the endless track 406 by means of feeding pins 416 extending into feeding holes 418 of the endless track 406. Except for the just described differences due to the drive mechanism, the structure of this second embodiment corresponds to that of the first embodiment.

Figure 5:
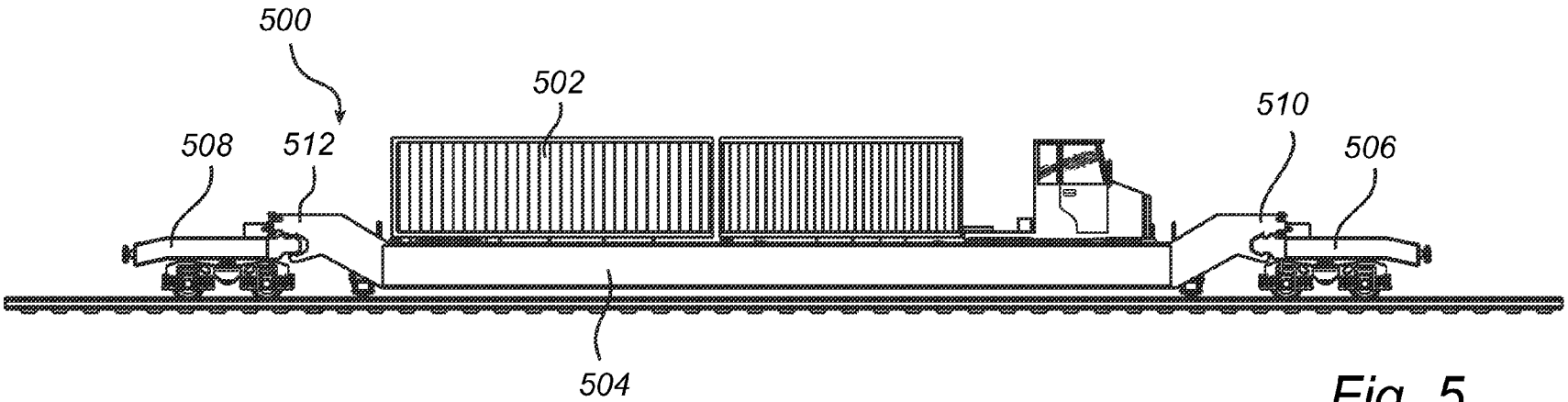
FIG. 5 is a schematic side view of a railway wagon according to the invention with a truck loaded thereon.
Figure 6A:
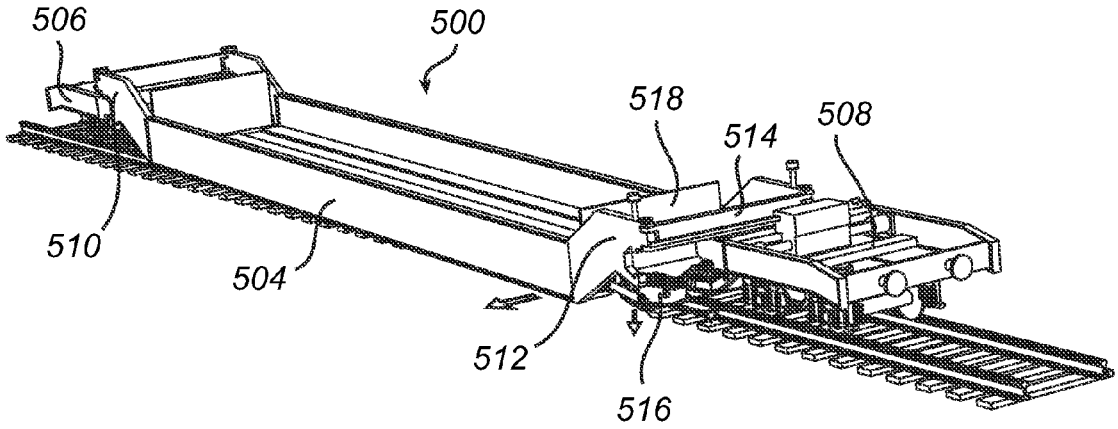
FIGS. 6*a* to 6*c* are schematic perspective views illustrating a loading process.
Figure 6B:
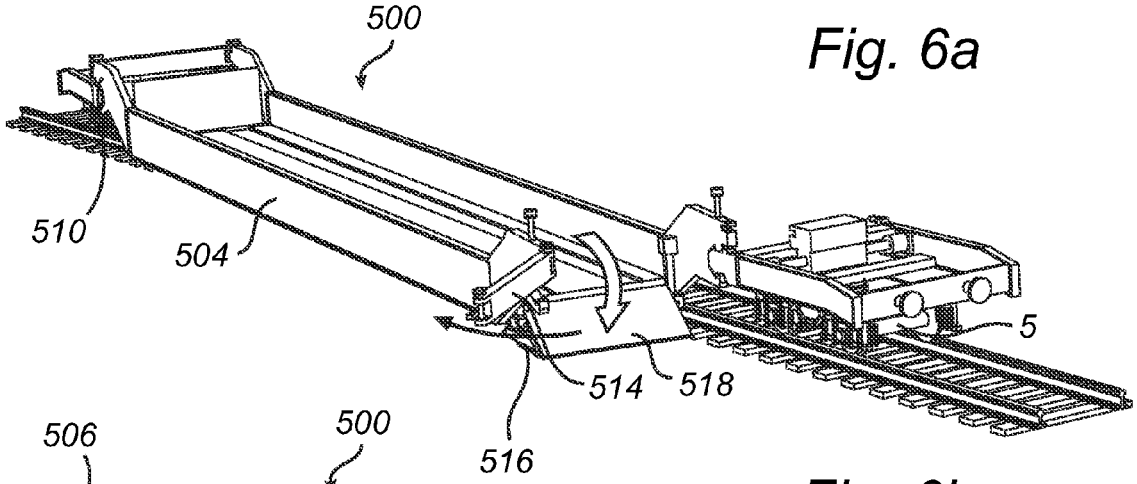
Figure 6C:
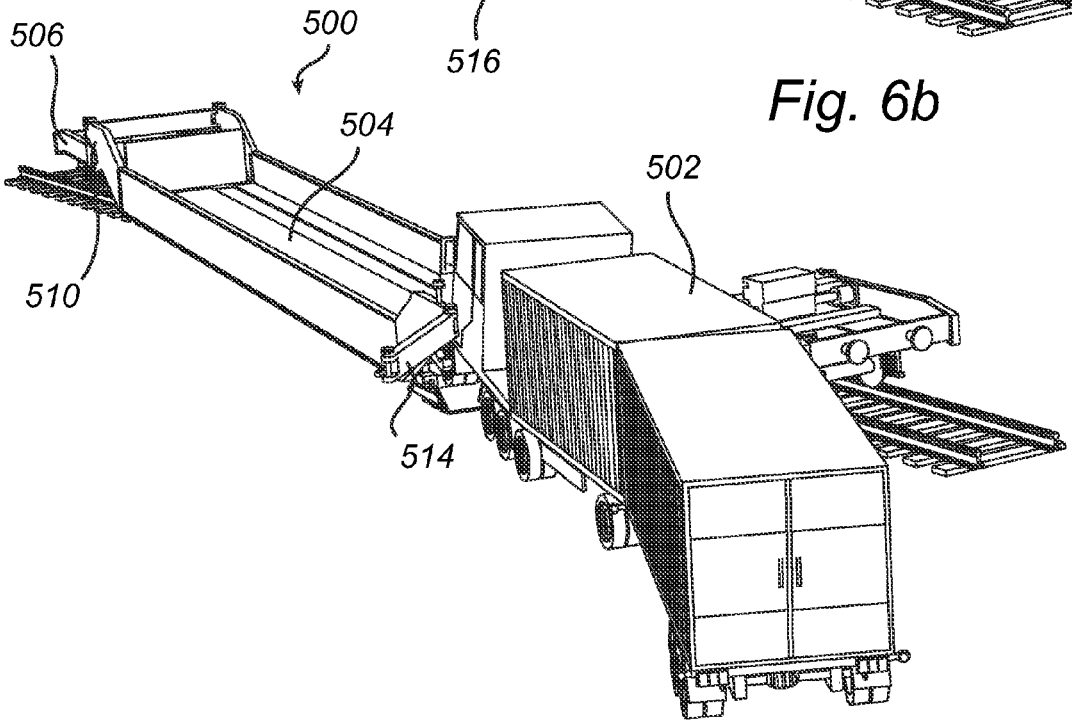
Figure 7:
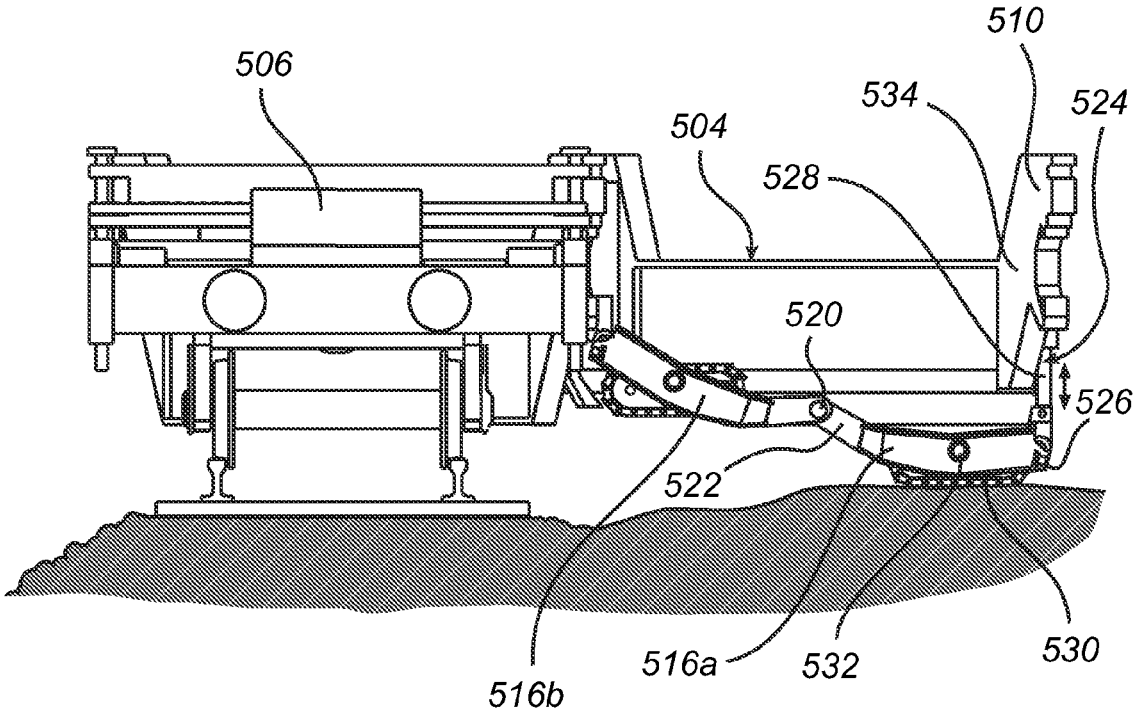
FIG. 7 is a schematic view from the end of the railway wagon in a laterally displaced position.
Figure 8:
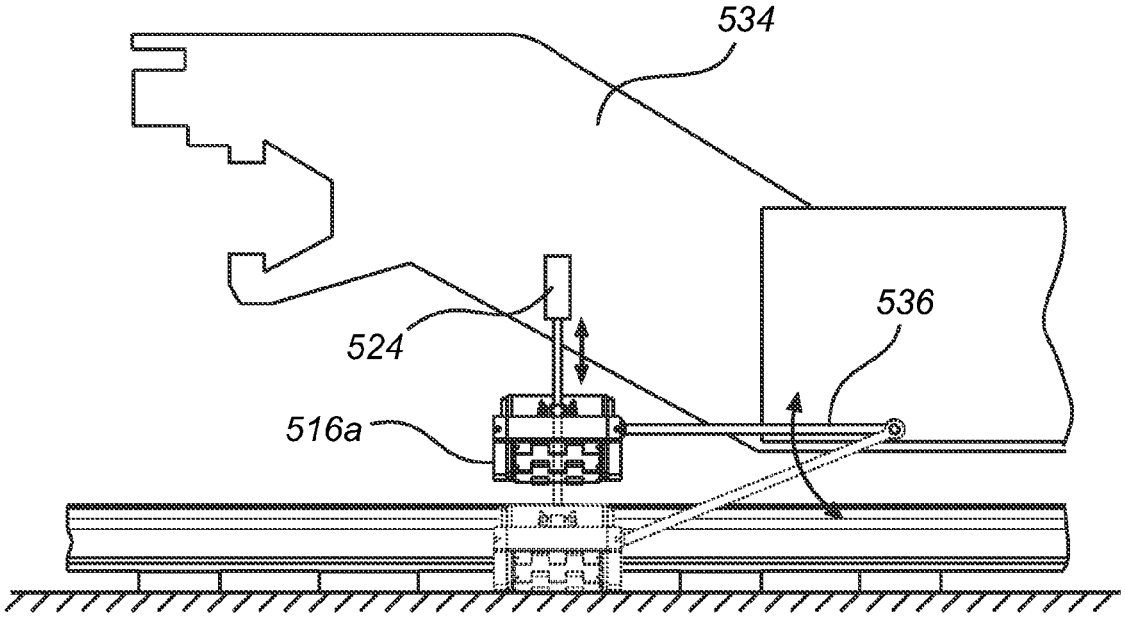
FIG. 8 is a schematic side view of an end portion of a load carrier of the wagon.

The invention additionally concerns a displaceable railway wagon which is designed for the modern concept of loading and unloading of entire vehicles, and which is provided with the support device. This concept, an embodiment of such a railway wagon, and the operation of the support device, will be described with reference to FIGS. 5 to 7. FIG. 5 illustrates a railway wagon 500 which carries a truck 502 on a load carrier 504 of the railway wagon 500. The load carrier 504 is releasably connected to front and rear bogies 506, 508. When loading of a vehicle, for instance a truck 502, is to occur, one end, e.g. the rear end 512, of the load carrier 504 is released from the rear bogie 508 and displaced, in this case by being pivoted on a pivot which is positioned at its other end, i.e. front end 510, relative to the front bogie 506, see FIGS. 6*a* to 6*c*. During the displacement the support device 516, according to any embodiment thereof, is lowered to the ground for supporting the load carrier 504 and eliminating the risk of tilting. A crossbar 514, which slides on a portion on the bogie 508 during the displacement, is released at its one end and pivoted away, see FIG. 6*b*, and a loading and unloading ramp 518 is lowered. Then the vehicle 502 can drive up on the load carrier 504, via the ramp 518, and finally the load carrier 504 is returned to the initial position and locked. The front end 510 of the load carrier 504 can also be pivoted outwards in a corresponding manner, either as an alternative to the rear end or in conjunction with the rear end 512 to position the load carrier 504 in parallel with the railroad.

Two support devices 516*a*, 516*b* are arranged at the end 510 of the load carrier 504. The support devices 516*a*, 516*b* are identical but mirror-inverted. Only one of them will therefore be described further. The first suspension portion 522 of the support device 516*a* is rotatably attached to a rotation member, or rotation pin, 520 rigidly mounted on the load carrier 504. The second suspension portion 526 of the support device 516*a* is rotatably attached to an operation device 524, and more particularly to the end of an operating arm 528 of the operating device 524.

The operating device 524 is mounted on the outside of a lateral beam 534 of the load carrier 504, which lateral beam 534 is connected with the bogie 506 in a non-displaced state. It should be noted that the operating device 524 could be mounted on the inside of the lateral beam 534, or within a cavity thereof, as well if more appropriate for a particular application. The operating device 524 is a piston-and-cylinder assembly which is adapted to lower and raise the support device, and thereby to rotate the same about the rotation member 520. As a result, the support device 516*a* is vertically displaced. When the support device 516*a* is lowered from an idle position to a support position, the endless track 530 abuts the ground. Due to the seesawing about the connection shaft 532 the endless track aligns 530 with the ground whether flat or inclined.

The support device 516*a* might be subject to transversal forces. In order to assure that such forces will not harm the structure, it can be provided with a side support member 536, here embodied by a relatively long rigid rod, which, at one end, is rotatably attached to the support device in the vicinity of the second suspension portion 526, and which, at the other end, is rotatably attached to the outside of the lateral beam 534. When the support device 516*a* is lowered and raised the side support member 536 causes it to be transversally displaced since the side support member 536 rotates like a hand of a clock about the attachment to the lateral beam 534. However, since the length of the side support member 536, and thus the radius of rotation, is relatively long, the displacement is negligible.

Figure 9:
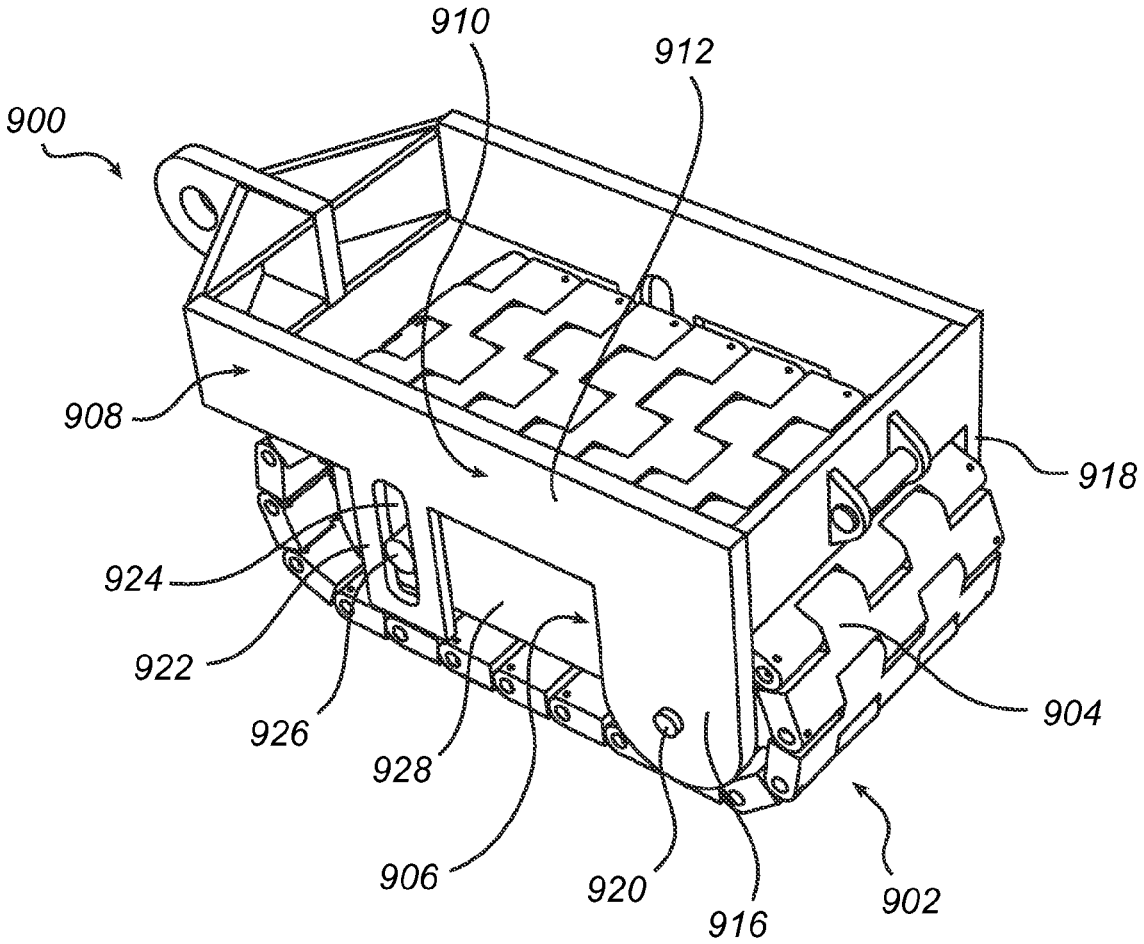
FIG. 9 is a schematic perspective view of an alternative embodiment of a support device according to the present invention.

According to a second embodiment of the support device, as illustrated in FIG. 9, the support device 900, like in the first embodiment, comprises a track device 902 including an endless track 904 and a body 906 carrying the endless track 904. The support device 900 further comprises a track device holder 908, which is pivotally connected with the body 906 via a connection shaft 920 extending transversally through the body 906, which also corresponds to the first embodiment. The track device holder comprises a generally rectangular and collar shaped base portion 910. However, unlike the first embodiment, the connection shaft is not arranged at the centre of the track device 902, but it has been longitudinally moved towards one end of the track device 902. More particularly, the connection shaft 920 is embodied by the centre shaft of one of the turn rolls. The base portion 910 has been raised above the track 904, and each side portion 912, 914 is provided with a connection protrusion 916, 918, which protrudes downwards and is provided with a seat for the connection shaft 920. Since, consequently, the pivot axis of the track device 902 is positioned close to one end of the track device 902 a situation could occur where the track device is forced to pivot excessively. In order to prevent such a situation, a pivot limiter 922 is connected with the body of the track device and with the track device holder at a distance from the connection shaft 920. In this second embodiment of the support device, the pivot limiter is constituted by a vertically protruding limiter portion 922 of the track device holder 908. The limiter portion 922 has an elongated vertical aperture 924 wherein an end portion of the centre shaft 926 of the other turn roll, which is not used as the connection shaft, has been received. Here, the centre shaft 926 has been somewhat extended in comparison with that of the first embodiment. Thus, if the track device 904 pivots to a certain angle about the connection shaft 920 the centre shaft 924 of the turn roll reaches the end of the vertical aperture 924. The pivot limiter 922 has a further function as track displacement preventer. That is, the pivot limiter 922, in conjunction with the connection protrusions 916, 918, prevent the track 904 from being laterally displaced on the body of the track device, which could otherwise occur since the track itself is not provided with any guide means to keep it aligned with the rolls. As an alternative, the pivot limiter is arranged somewhere between the turn roll shafts and a separate stop pin is arranged on the side plate 928 on both sides of the track device 902.

Above embodiments of the support device and the railway wagon according to the present invention as defined in the appended claims have been described. These should only be seen as merely non-limiting examples. As understood by the person skilled in the art, many modifications and alternative embodiments are possible within the scope of the invention as defined by the appended claims.

It is to be noted that for the purposes of his application, and in particular with regard to the appended claims, the word "comprising" does not exclude other elements or steps, and the word "a" or "an" does not exclude a plurality, which per se will be evident to a person skilled in the art.

The invention claimed is:

1. A support device for a laterally displaceable railway wagon, the support device comprising:

a track device including an endless track, and a body carrying the endless track; and a track device holder, which is pivotally connected with the body via a connection shaft extending transversally through the body, and being encircled by the endless track, wherein the track device holder comprises opposite first and second side portions extending along the length of the track device, a first end portion connected with the first and second side portions at one end thereof, a second end portion connected with the side portions at the other end thereof, a first suspension portion included in said first end portion, and a second suspension portion included in said second end portion, and wherein the track device at least partly extends below the track device holder.

2. A support device according to claim 1, wherein the track device holder comprises slide stop portions, keeping the track from excessive lateral displacement on the body, arranged on either side of the track device.

3. A support device according to claim 2, wherein the body comprises opposite side plates covering the interior of the body, and supporting the track, at an inner surface thereof, the side plates each comprising a seat for receiving the connection shaft, which extends through the seats and is connected with the track device holder.

4. A support device according to claim 2, wherein the track comprises solid links, which are pivotally connected with each other.

5. A support device according to claim 4, wherein each link is elongated and has generally square wave shaped long side surfaces, where a top portion of one long side surface is opposite to a bottom portion of the other long side surface, and wherein the links are interconnected by means of connection pins extending along the length of the links through the top portions.

6. A support device according to claim 1, wherein the track is non-driven.

7. A support device according to claim 1, wherein the track device comprises a drive unit arranged to drive the track.

8. A support device according to claim 1, wherein the body comprises opposite side plates covering the interior of the body, and supporting the track, at an inner surface thereof, the side plates each comprising a seat for receiving the connection shaft, which extends through the seats and is connected with the track device holder.

9. A support device according to claim 8, wherein the track comprises solid links, which are pivotally connected with each other.

10. A support device according to claim 9, wherein each link is elongated and has generally square wave shaped long side surfaces, where a top portion of one long side surface is opposite to a bottom portion of the other long side surface, and wherein the links are interconnected by means of connection pins extending along the length of the links through the top portions.

11. A support device according to claim 8, wherein the body comprises two turn rolls arranged within the endless track, and rotatably attached to the side plates at their respective ends, wherein the turn rolls are arranged to tension the endless track.

12. A support device according to claim 11, wherein the connection shaft is embodied by the centre shaft of one of the turn rolls, and wherein a pivot limiter is connected with the body and with the track device holder at a distance from the connection shaft.

13. A support device according to claim 8, wherein the connection shaft is arranged centrally of the track device, and wherein the track device is able to seesaw relative to the track device holder.

14. A support device according to claim 1, wherein the first and second side portions and the first and second end portions of the track device holder defines a collar shaped structure.

15. A support device according to claim 14, wherein a part of the track device extends below the collar shaped structure, and wherein a part of the track device is encircled by the collar shaped structure.

16. A support device according to claim 1, wherein the track comprises solid links, which are pivotally connected with each other.

17. A support device according to claim 16, wherein each link is elongated and has generally square wave shaped long side surfaces where a top portion of one long side surface is opposite to a bottom portion of the other long side surface, and wherein the links are interconnected by means of connection pins extending along the length of the links through the top portions.

18. A laterally displaceable railway wagon comprising a support device according to claim 1.

19. A railway wagon according to claim 18, comprising a load carrier and front and rear bogies, the load carrier being releasably connected to the respective bogies, and laterally displaceable in relation to the respective bogies, the load carrier having a front end and a rear end and being at each end provided with the support device, which supports the load carrier in a position where it is displaced in relation to the bogie, each support device being vertically operable between an idle position and a support position, in which the support device abuts against a base.

20. A railway wagon according to claim 19, further comprising an operating device at each end of the load carrier, for lowering and raising the support device, the first suspension portion of the track holder being rotatably attached to the load carrier, and the second suspension portion of the track holder being rotatably attached to the operating device.

* * * * *